US008992272B1

(12) United States Patent
Malakiman

(10) Patent No.: US 8,992,272 B1
(45) Date of Patent: Mar. 31, 2015

(54) STAND-UP PEDAL BOARD

(71) Applicant: Shahriar Malakiman, San Jose, CA (US)

(72) Inventor: Shahriar Malakiman, San Jose, CA (US)

( * ) Notice: Subject to any disclaimer, the term of this patent is extended or adjusted under 35 U.S.C. 154(b) by 76 days.

(21) Appl. No.: 14/020,709

(22) Filed: Sep. 6, 2013

(51) Int. Cl.
*B63H 16/18* (2006.01)
*B63H 1/36* (2006.01)

(52) U.S. Cl.
CPC . *B63H 1/36* (2013.01); *B63H 16/18* (2013.01)
USPC ..... 440/21; 440/32

(58) Field of Classification Search
USPC ..... 440/21, 32
IPC ..... B63H 16/12,16/14, 16/18
See application file for complete search history.

(56) References Cited

U.S. PATENT DOCUMENTS

| | | | | |
|---|---|---|---|---|
| 3,083,382 | A | 4/1963 | Havens et al. | |
| 4,264,313 | A * | 4/1981 | Kort | 440/17 |
| 4,459,116 | A | 7/1984 | Moore | |
| 4,648,846 | A | 3/1987 | Hsu | |
| 4,936,802 | A * | 6/1990 | Ueno | 440/13 |
| 4,968,274 | A | 11/1990 | Gregory | |
| 5,194,024 | A | 3/1993 | Shiraki | |
| 6,468,118 | B1 * | 10/2002 | Chen | 440/21 |
| 6,595,813 | B1 * | 7/2003 | Lekhtman | 440/21 |
| 7,267,586 | B1 * | 9/2007 | Murphy | 440/32 |
| 2010/0255736 | A1 * | 10/2010 | Krah | 440/25 |
| 2013/0157529 | A1 * | 6/2013 | Santa Catarina | 440/21 |

* cited by examiner

*Primary Examiner* — Stephen Avila
(74) *Attorney, Agent, or Firm* — Benedict O'Mahoney

(57) ABSTRACT

In accordance with the present invention, there is provided a stand-up pedal board wherein propulsion is provided to the stand-up pedal board by applying alternating downward force to foot pedals to swing a fin side to side through transfer of energy from foot pedal shafts rotating around a T brace, swinging the bottom of the T brace, with the forward end of the fin rotating around a connector.

15 Claims, 6 Drawing Sheets

STAND-UP PEDAL BOARD

CROSS-REFERENCE TO RELATED APPLICATIONS

Not applicable.

FEDERALLY SPONSORED RESEARCH

Not applicable.

SEQUENCE LISTING OR PROGRAM

Not applicable.

FIELD OF INVENTION

The present invention relates to the field of human powered watercraft.

BACKGROUND OF THE INVENTION

Man has long desired to possess a simply structured watercraft which would allow him to use his weight and leg strength, as by a pedaling operation, to power the craft. Various devices have been proposed, but these have various inadequacies. Some turn a screw propeller which usually provides little water-moving surface, and this is inefficient using the limited power available to a single person. Some rotate a large wheel, but these are bulky. It has not heretofore been possible to provide a simple and easily transportable structure which would allow limited foot movement to provide an extended powered path through the water.

Individually propelled water crafts such as rowing boats, paddle boats, etc., are known. There are water crafts and vessels which include paddles operated by rotating pedals on crank arms similar to the operation of a bicycle.

Water cycles have heretofore been proposed of the type that are manually operated by a pedal driven propeller assembly. Some of these cycles utilize front propeller drives wherein the craft is pulled through the water with the operator facing forwardly. One such cycle is illustrated in U.S. Pat. No. 3,083,382 wherein a pedal operated front propeller drive assembly is supported on a pair of pontoons and an operator's seat is located rearwardly thereof for foot engagement of the pedal drive. Steering is accomplished by a rudder assembly and steering rod. U.S. Pat. Nos. 4,459,116 and 4,648,846 also disclose a water craft structure that is pedal driven. These devices utilize propeller drive assemblies that pivot on a vertical axis to accomplish steering.

There has also been an attempt to make skis that one can use on the water. In the past this concept of utilizing floating skis has not been successful simply because it is difficult to keep the skis oriented and pointing in one direction and unless the water is very still, progression on the water does not occur. If the skis comprise floats then by moving them backwards and forwards there is no resultant force to move the skier in the desired direction.

Kayaks are traditionally propelled by the use of a paddle (or oar), which is manipulated by the hands and arms of a user. One disadvantage of using a paddle for propulsion is that the blade of the paddle is an inefficient means of providing thrust. Further, the user of the kayak has limited power available in the arms and hands relative to the legs, and therefore the user will tend to tire easily. Because of both the inefficient nature of the paddle and the limited power available through the arms and hands of the user, the traditional kayak has a limited boat speed, particularly when traveling for an extended distance. Another disadvantage with the use of a paddle is that the paddle requires the use of both hands for paddling, steering, and other manipulation. Thus, both hands of the user are occupied at all times that propulsion is provided to the kayak, and the user is unable to grasp and hold items while providing propulsion to the kayak. Therefore, the user is unable to move materials about in the cockpit, or to engage in non-kayak specific activities such as photography or fishing.

In alternative approaches, such as in U.S. Pat. Nos. 4,968,274 and 5,194,024, pedals and propellers have been attached to catamaran-type, pontoon watercraft, and even to surfboards. However, the catamaran-type designs are bulky, typically require disassembly and assembly for transport to and from a body of water, and are difficult to return to upright in the event the watercraft capsizes.

These watercraft also are typically capable of attaining only very limited speeds. Thus, there has gone unmet a need for a watercraft providing a stable platform, an ability to stand upright and superior speed and endurance. The present invention provides these and other related advantages.

SUMMARY OF THE INVENTION

In accordance with the present invention, there is provided a stand-up pedal board wherein propulsion is provided to the stand-up pedal board by applying alternating downward force to foot pedals to swing a fin side to side through transfer of energy from foot pedal shafts rotating around a T brace, swinging the bottom of the T brace, with the forward end of the fin rotating around a connector.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION

Figure 1:
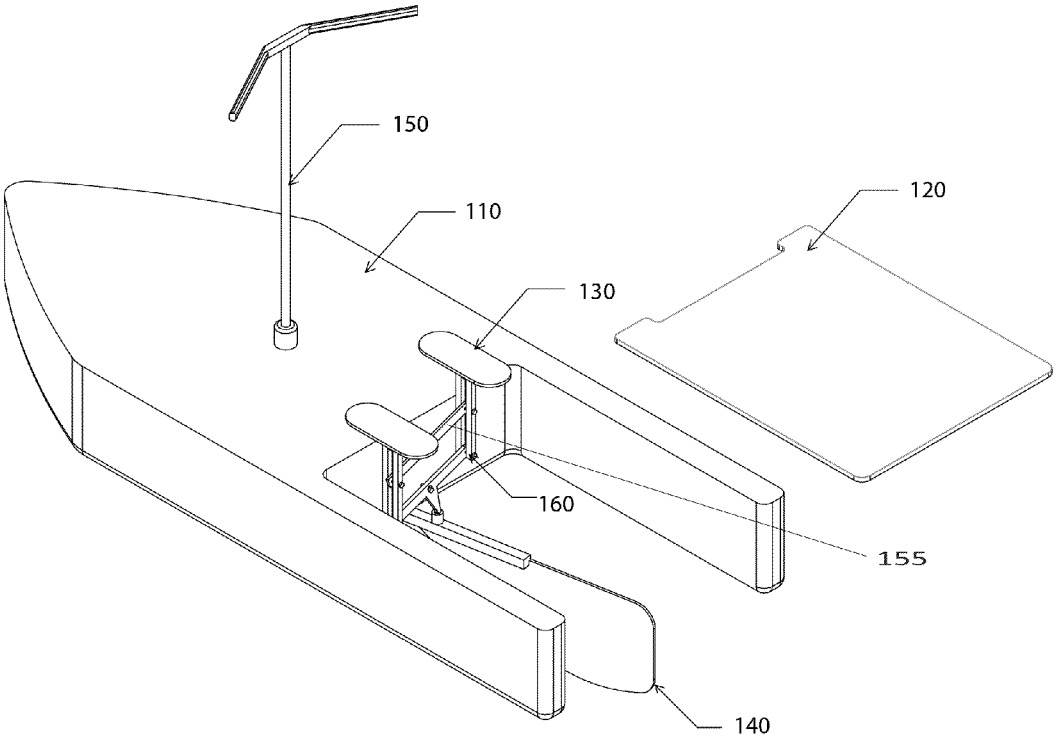
FIG. 1 is an oblique top view of a stand-up pedal board.

Before the invention is described in further detail, it is to be understood that the invention is not limited to the particular embodiments described, as such may, of course, vary. It is also to be understood that the terminology used herein is for the purpose of describing particular embodiments only, and not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed with the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, if dates of publication are provided, they may be different from the actual publication dates and may need to be confirmed independently.

The present invention provides a pedal-powered board wherein the propulsion of the board is provided by a fin. Because a fin is significantly less complex than a propeller system and is a significantly more efficient means of providing propulsion than a paddle blade, and because the legs of a user are stronger than the arms of a user, the propulsion system provides a significantly improved, more efficient means of moving a kayak through the water than a tradition paddle. In accordance with this feature of the invention, a user of the stand-up pedal board tires less easily and is able to reach a desired destination more quickly. Further, the provision of a pedal propulsion system frees the hands of a user for activities other than providing propulsion even though the board is underway.

Turning now to FIG. 1, a board 110 is shown, which could be a modified stand-up paddle board, surf board or any flat surface watercraft. The removable stand cover 120 is attached to the board 110 to allow a user to stand upon the board 110 and actuate the foot pedals 130. By stepping up and down upon the foot pedals 130, the user causes a linkage comprising a top brace 155 and T brace 160 to move up and down, thereby causing the fin 140 to move from side to side, thereby providing propulsion to the board 110. The optional hand pole 150 provides additional stability to the user.

Figure 2:
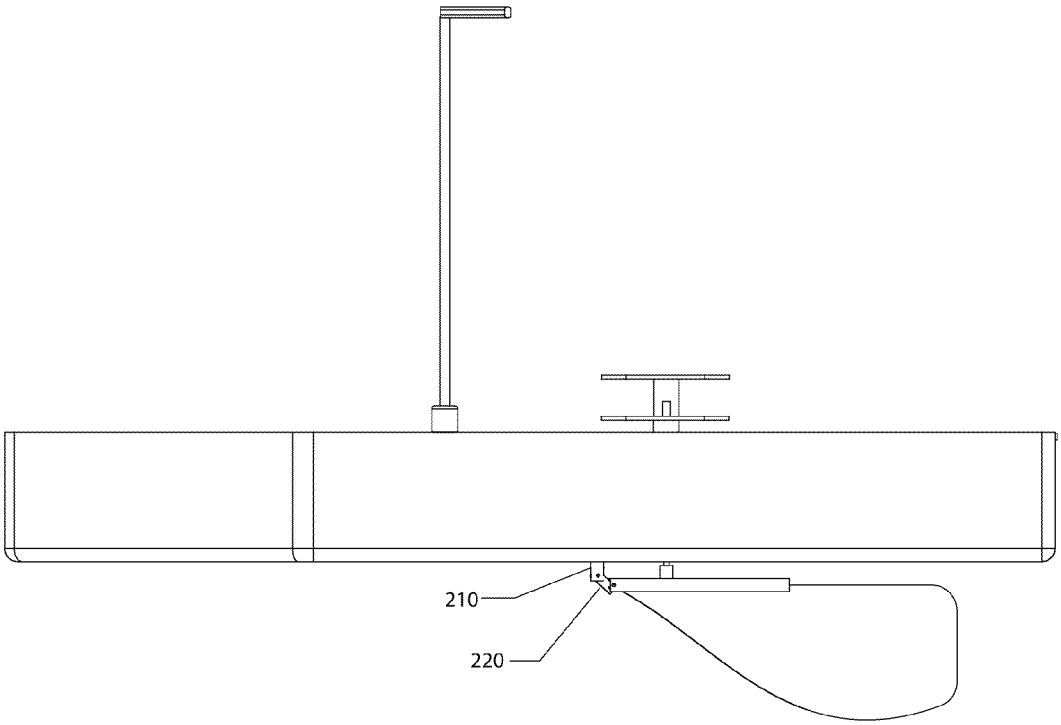
FIG. 2 is a side view of a stand-up pedal board.

Turning now to FIG. 2, the board 110 is shown in side view, thereby showing the first connector 210 connected to the second connector 220. The first connector 210 comprises a shaft that is attached to the board 110 such that the shaft can rotate around it's vertical axis, and the second connector 220 is fixedly attached to the fin 140. The second connector 220 allows the fin 140 to move from side to side, while keeping its forward point fixed at the site of the first connector 210.

Figure 3:
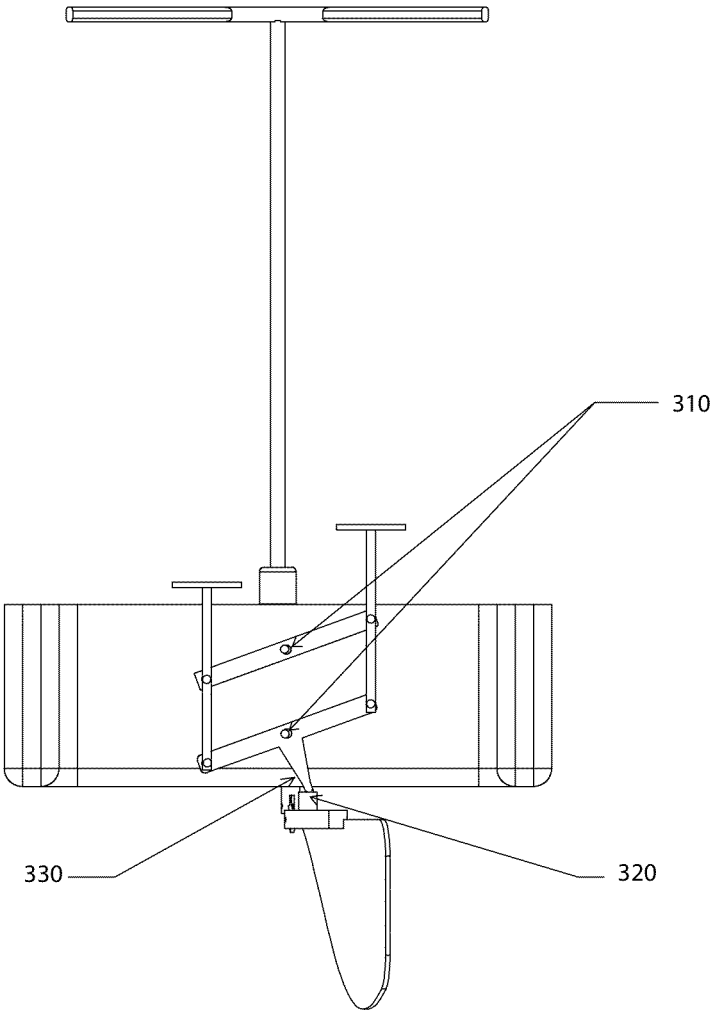
FIG. 3 is a rear view of a stand-up pedal board.

Turning now to FIG. 3, an embodiment is shown wherein two fixed point pivots 310 provide an axis wherein the movement of the foot pedals cause bottom portion of the T brace comprising a swing arm 330 to move from side to side. The swing arm 330 is connected to the ball joint 320, which is fixedly attached to the fin 140. When the swing arm 330 moves from side to side, the swing arm moves the ball joint 320 and thereby the fin 140 to also move from side to side, thereby providing propulsive force through the water.

Figure 4:
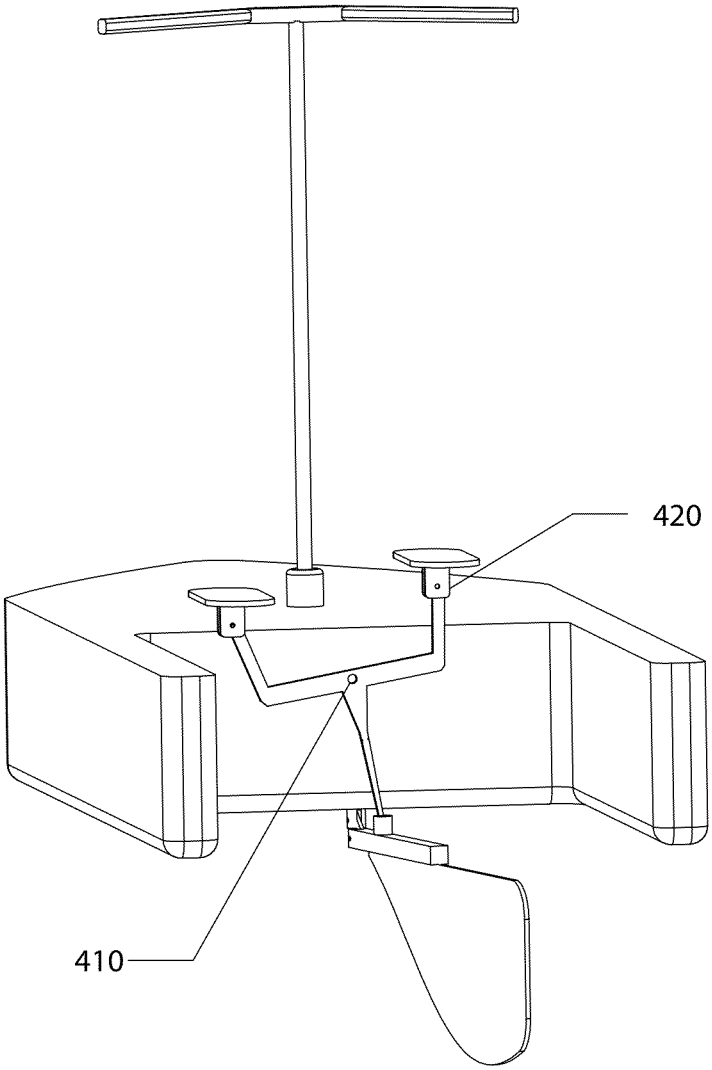
FIG. 4 is an oblique rear view of a stand-up pedal board.

Turning now to FIG. 4, another embodiment is shown in which foot pedals 130 are attached to the upper tines of a forked swing arm by foot pedal pivots 420. The foot pedal pivots 420 allow the forked swing arm to move from side to side without tilting the foot pedals 130. The forked swing arm is attached to the board 110 by the single pivot point 410. When the user provides up and down motion to the foot pedals 130, the forked swing arm rotates around the single pivot point 410, thereby transferring the side to side motion to the fin 140, thereby providing propulsive force through the water.

Figure 5:
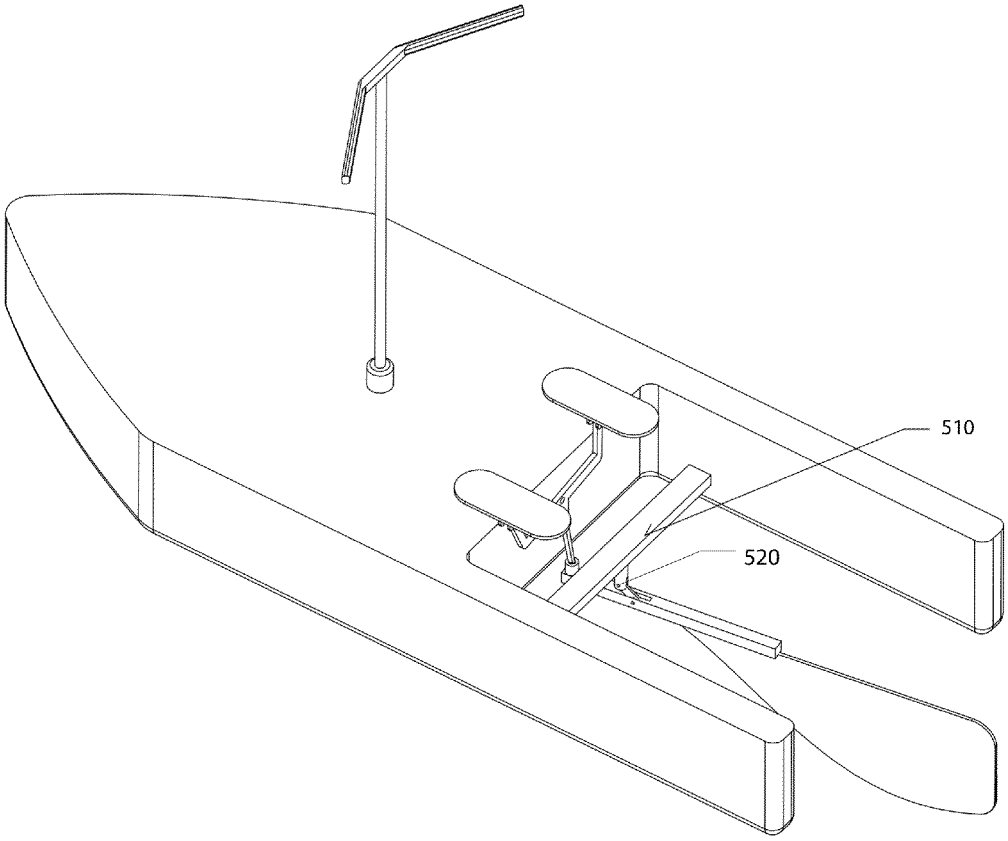
FIG. 5 is a side view of a stand-up pedal board.
Figure 6:
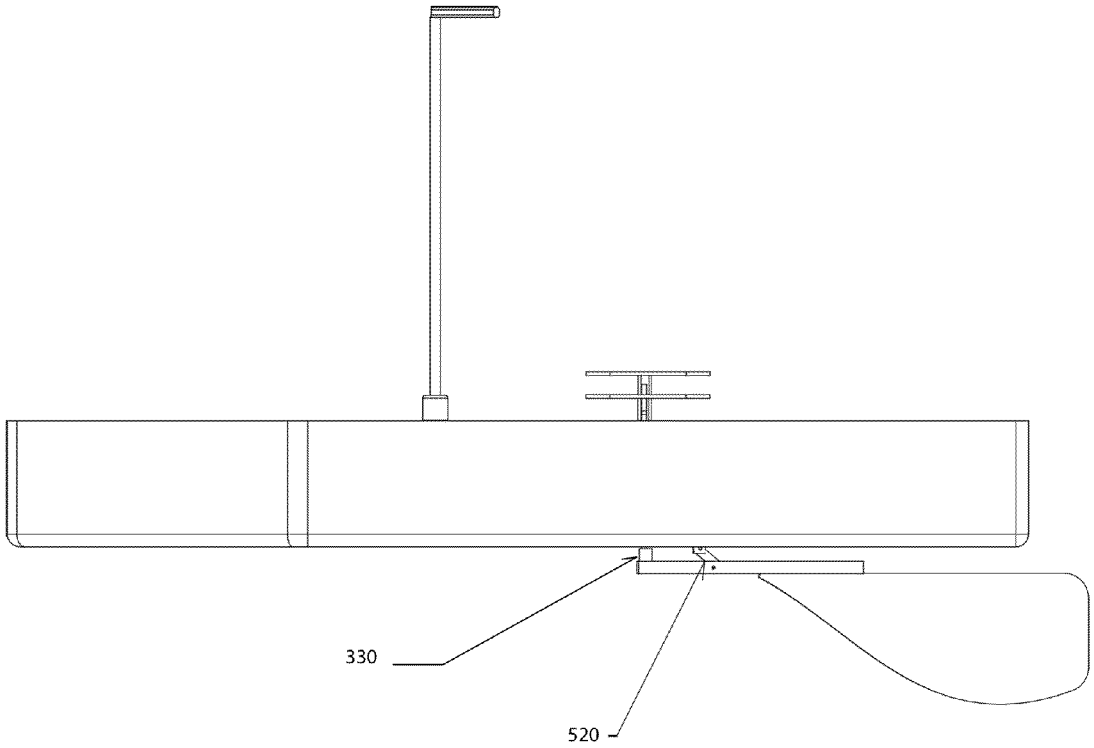
FIG. 6 is an oblique rear view of a stand-up pedal board.

Turning now to FIG. 5, another embodiment is shown in which a cross member 510 is fixedly attached to the board 100 above the fin 140. The cross member 510 is also connected to the fin 140 by the fin pivot joint 520. The foot pedals 130 allow the forked swing arm 330 to move from side to side where the forked swing arm is attached to the board 110 by the single pivot point 410. When the user provides up and down motion to the foot pedals 130, the forked swing arm rotates around the single pivot point 410, thereby transferring the side to side motion to the fin 140, which rotates around the axis of the fin pivot joint 510, thereby providing propulsive force through the water. FIG. 6 shows the same embodiment from a side view in which the fin pivot joint 520 can be seen positioned behind the ball joint 320.

It should be further understood that the examples and embodiments pertaining to the systems and methods disclosed herein are not meant to limit the possible implementations of the present technology. Further, although the subject matter has been described in a language specific to structural features and/or methodological acts, it is to be understood that the subject matter defined in the appended claims is not necessarily limited to the specific features or acts described above. Rather, the specific features and acts described above are disclosed as example forms of implementing the claims.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A stand-up pedal board comprising:

a. a board;

b. two foot pedals;

c. two foot pedal shafts, wherein each said foot pedal shaft is pivotally attached to one of said foot pedals;

d. a T brace, wherein the bottom of each said foot pedal shaft is fixedly connected to each side of the top of said T brace, and the center of the top of said T brace is rotatably attached to said board;

e. a fin;

f. a ball joint connected the bottom of said T brace, wherein said ball joint pivotally attaches said T brace to said fin;

g. a first connector rotatably connected to said board;

h. a second connector rotatably connected to said first connector and fixedly connected to said fin;

i. wherein propulsion is provided to said board by applying alternating downward force to said foot pedals to swing said fin side to side through transfer of energy from said foot pedal shafts rotating the top of said T brace, swinging the bottom of said T brace, with the forward end of said fin rotating around said first connector.

2. The stand-up pedal board of claim 1, further comprising a stand cover concealing said T brace, said ball joint, said fin, said first connector and said second connector.

3. The stand-up pedal board of claim 1, further comprising a hand pole fixed attached to said board.

4. The stand-up pedal board of claim 1, wherein said two foot pedal shafts and said T brace are composed of a single unit of manufacture.

5. The stand-up pedal board of claim 1, wherein said board comprises a surfboard.

6. A stand-up pedal board comprising:

a. a board;

b. two foot pedals;

c. two foot pedal shafts, wherein each said foot pedal shaft is pivotally attached to one of said foot pedals;

d. a horizontal brace, wherein the middle of each foot pedal shaft is fixedly connected to each side of said horizontal brace, and the center of said horizontal brace is rotatably attached to said board;

e. a T brace, wherein the bottom of each foot pedal shaft is fixedly connected to each side of the top of said T brace, and the center of the top of said T brace is rotatably attached to said board;

f. a fin;

g. a ball joint connected the bottom of said T brace, wherein said ball joint pivotally attaches said T brace to said fin;

h. a first connector rotatably connected to said board;

i. a second connector rotatably connected to said first connector and fixedly connected to said fin;

j. wherein propulsion is provided to said board by applying alternating downward force to said foot pedals to swing said fin side to side through transfer of energy from said foot pedal shafts rotating the horizontal brace and top of said T brace, swinging the bottom of said T brace, with the forward end of said fin rotating around said first connector.

7. The stand-up pedal board of claim 6, further comprising a stand cover concealing said T brace, said ball joint, said fin, said first connector and said second connector.

8. The stand-up pedal board of claim 6, further comprising a hand pole fixed attached to said board.

9. The stand-up pedal board of claim 6, wherein said two foot pedal shafts and said T brace are composed of a single unit of manufacture.

10. The stand-up pedal board of claim 6, wherein said board comprises a surfboard.

11. A stand-up pedal board comprising:

a. a board;

b. two foot pedals;

c. two foot pedal shafts, wherein each said foot pedal shaft is pivotally attached to one of said foot pedals;

d. a horizontal brace, wherein the middle of each foot pedal shaft is fixedly connected to each side of said horizontal brace, and the center of said horizontal brace is rotatably attached to said board;

e. a T brace, wherein the bottom of each foot pedal shaft is fixedly connected to each side of the top of said T brace, and the center of the top of said T brace is rotatably attached to said board;

f. a fin;

g. a ball joint connected the bottom of said T brace, wherein said ball joint pivotally attaches said T brace to said fin;

h. a cross member fixedly connected to said board, wherein said cross member is situated rearward of said T brace;

i. a first connector rotatably connected to said cross member;

j. a second connector rotatably connected to said first connector and fixedly connected to said fin;

k. wherein propulsion is provided to said board by applying alternating downward force to said foot pedals to swing said fin side to side through transfer of energy from said foot pedal shafts rotating the horizontal brace and top of said T brace, swinging the bottom of said T brace, with the mid-forward end of said fin rotating around said first connector.

12. The stand-up pedal board of claim 11, further comprising a stand cover concealing said T brace, said ball joint, said fin, said first connector and said second connector.

13. The stand-up pedal board of claim 11, further comprising a hand pole fixed attached to said board.

14. The stand-up pedal board of claim 11, wherein said two foot pedal shafts and said T brace are composed of a single unit of manufacture.

15. The stand-up pedal board of claim 11, wherein said board comprises a surfboard.

* * * * *